United States Patent [19]

Lepisto

[11] Patent Number: 4,498,511

[45] **Date of Patent: * Feb. 12, 1985**

[54] APPARATUS FOR FILLING A VALVE BAG

[75] Inventor: J. George Lepisto, Middletown, Ohio

[73] Assignee: Champion International Corporation, Stamford, Conn.

[ * ] Notice: The portion of the term of this patent subsequent to Sep. 18, 2084 has been disclaimed.

[21] Appl. No.: 424,893

[22] Filed: Sep. 28, 1982

[51] Int. Cl.[3] ..... B65B 1/18

[52] U.S. Cl. ..... 141/85; 141/10

[58] Field of Search ..... 141/10, 65, 68, 114–117, 141/119, 313–317, 85, 89, 91, 93

[56] References Cited

U.S. PATENT DOCUMENTS

| | | | |
|---|---|---|---|
| 3,072,208 | 1/1963 | Titchenal et al. | 141/119 X |
| 3,137,328 | 6/1964 | Swenson et al. | 141/315 |
| 3,258,041 | 6/1966 | Lau | 141/10 |
| 3,331,404 | 7/1967 | Gehring et al. | 141/119 X |
| 3,384,134 | 5/1968 | Hillerns | 141/10 |
| 4,219,054 | 8/1980 | Carter et al. | 141/10 |

*Primary Examiner*—Stephen Marcus
*Assistant Examiner*—Mark Thronson
*Attorney, Agent, or Firm*—Evelyn M. Sommer

[57] ABSTRACT

An apparatus and method for use in filling a valve bag eliminates sifting of product during the filling process. A filling nozzle is inserted into the valve of a bag to be filled. A flow of particulate material is provided through the filling nozzle and into the bag. When the bag is full, the flow of particulate material is terminated. A blast of high pressure air is then introduced into the nozzle in order to clear the nozzle of any residual particulate material therein. A low pressure blast of air is introduced between the nozzle and the filling valve to suspend any particles present in the filling valve after the nozzle has been cleared by the high pressure blast. A vacuum is introduced into the nozzle to suck any suspended particles out of the filling valve after the low pressure blast has been introduced. A boot can be inflated around the nozzle to seal the nozzle within the bag valve before filling the bag.

6 Claims, 8 Drawing Figures

APPARATUS FOR FILLING A VALVE BAG

BACKGROUND OF THE INVENTION

The present invention relates to the filling of valve bags with particulate material and, more particularly, to a method and system for controlling a novel filling nozzle which eliminates the sifting of product from the valve bag during and after the bag filling operation.

Particulate materials are commonly packaged in bags that are made from multiple layers of paper and have a "valve" in one upper corner. The valve provides an opening through which the material is dispensed during the bag filling operation. The valve bag is typically filled by inserting a spout or nozzle into the valve and causing material to flow through the nozzle into the bag. When the bag is full, the flow of material is halted and the nozzle is withdrawn from the valve usually by moving the bag away from the nozzle. The valve is sealed to prevent egress of the material from the bag during shipping and handling.

The control system and method of the present invention is particularly suited for use in conjunction with the filler sleeve disclosed in co-pending U.S. patent application Ser. No. 300,038 filed Sept. 8, 1981. The filler sleeve comprises an elongated tubular member which is connected to the top end of the bag. The tubular member includes an open end which is contiguous with a filler opening provided in the top end of the bag. The opposed end of the tubular member is closed, e.g. by heat sealing or folding. A longitudinally extending slit is provided in the tubular member disposed on the bottom surface thereof. In use, when the bag is filled by introducing the product by air flow or by gravity through a filler nozzle which is inserted into the filler opening and into the tubular member, the product is deflected downwardly into the bag thereby inhibiting the likelihood of blow-out of the side panels. Preferably, the tubular member is formed from a stretchable material such as polyethylene, so that during the filling of the bag the flow of the product stretches the material. By this arrangement, when the filling is completed, and the bag is inverted, the side edges of the slit, which have been stretched, overlap and the weight of the product functions to maintain the overlapping relationship thereby preventing the unwanted escape of product from the bag.

While the filling nozzle of the present invention is particularly suited for use with the slitted filler sleeve disclosed in the aforementioned copending application, those skilled in the art will appreciate that the present filling nozzle is also adaptable for use in conventional valve bags.

In filling valve bags, problems have been encountered in reducing or eliminating the sifting and dusting problems which occur. Typically, some amount of product will spill from the filling nozzle on its way into the bag or on its withdraw from the bag. Various hazardous products, such as toxic chemicals, clay, limestone, cement, carbon black, herbicides, fungicides, and the like are usually packaged in valve bags and the elimination of product sifting and dusting problems during the filling operation is therefore imperative. The slitted sleeve enhances bag performance and effectively reduces dusting, but does not completely eliminate the problem. Further, sifting can occur after the filling process is completed, e.g. during transit, if material is entrapped in the valve during the filling process. Such entrapment of material can occur if the filling nozzle does not directly discharge product through the slitted sleeve. Material can also become entrapped if product dribbles out of the nozzle into the sleeve at the end of the filling cycle.

It would be advantageous to provide an apparatus and method for filling a valve bag which directs the flow of product downwardly into the bag, thereby avoiding the direct discharge of product into the back end of the valve bag sleeve. It would be further advantageous if the apparatus and method included a purge system to clear the filling nozzle of all product after a bag has been filled, to substantially reduce product dribble out of the nozzle, and to clear any product from the valve sleeve which remains after the bag has been filled.

This invention relates to such an apparatus and method.

SUMMARY OF THE INVENTION

A system for controlling the operation of a valve bag filling nozzle is provided. The filling nozzle has a material passage therethrough and means for venting low pressure air at the external surface thereof. The control system comprises means for introducing a high pressure blast of air into the material passage of the nozzle to clear the nozzle of any residual product therein after a valve bag has been filled. Means are provided for introducing a low pressure blast of air into the vent means of the nozzle to suspend any product particles present in the valve of the bag after the introduction of the high pressure blast. Means are also provided for introducing a vacuum into the material passage of the nozzle to suck any suspended particles out of the valve after the introduction of the low pressure blast.

Also provided is a method for filling a valve bag with particulate material. A filling nozzle is inserted into the filling valve of a bag. A flow of particulate material is provided through the filling nozzle and into the bag. When the bag is full, the flow of particulate material through the filling nozzle is terminated. A blast of high pressure air is then introduced into the nozzle in order to clear the nozzle of any residual particulate material therein. A low pressure blast of air is then introduced between the nozzle and the filling valve to suspend particles present in the filling valve after the nozzle has been cleared by the high pressure blast. A vacuum is introduced into the nozzle to suck any suspended particles out of the filling valve after the low pressure blast has been introduced.

DETAILED DESCRIPTION OF THE INVENTION

Figure 1:
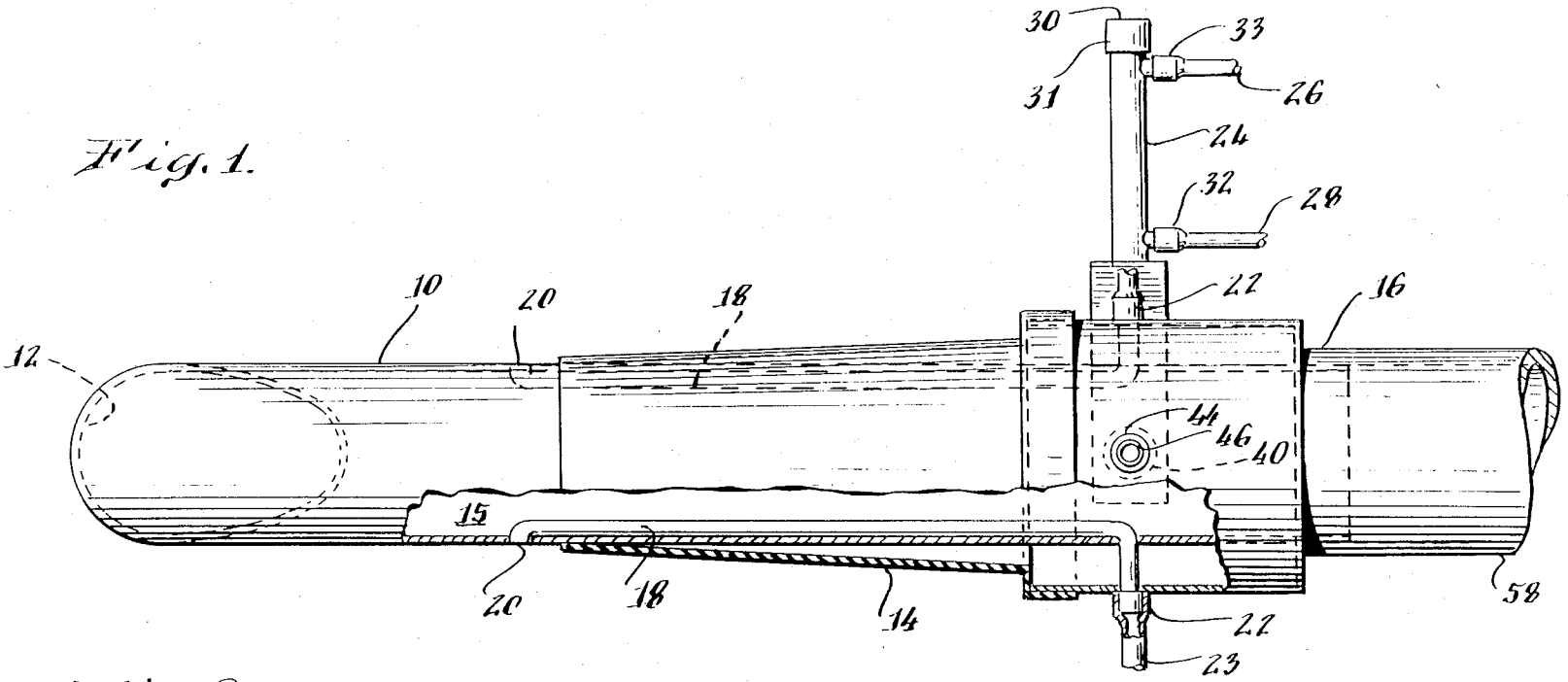
FIG. 1 is a top plan view, with partial cut-away, showing a filling nozzle suitable for use with the control system and method of the present invention.
Figure 2:
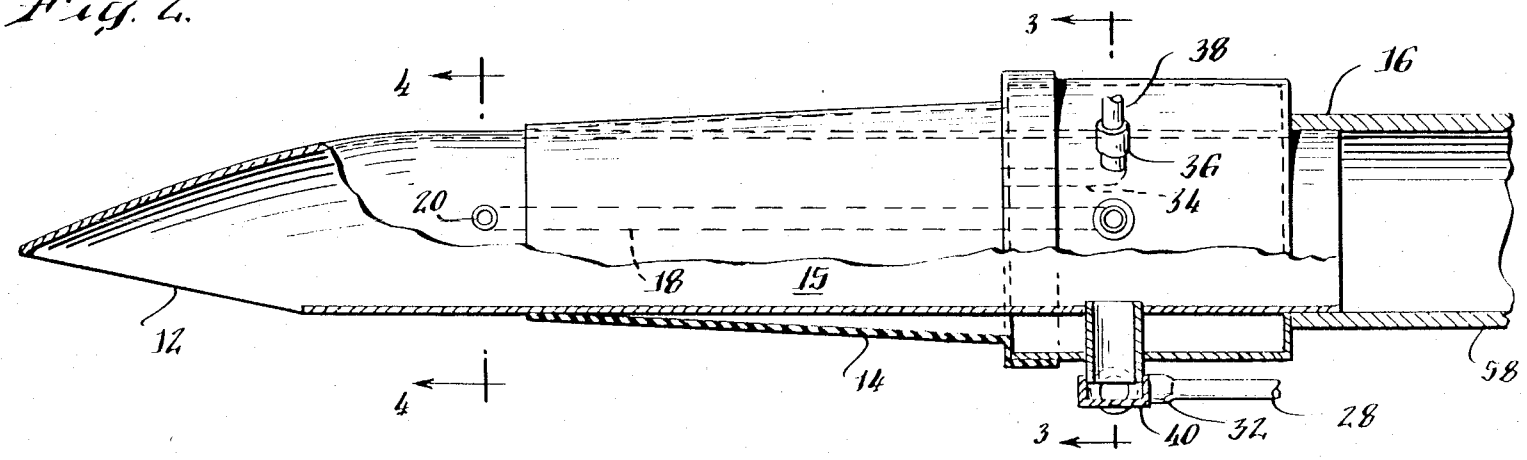
FIG. 2 is a side plan view, with partial cut-away, of the nozzle shown in FIG. 1.
Figure 5:
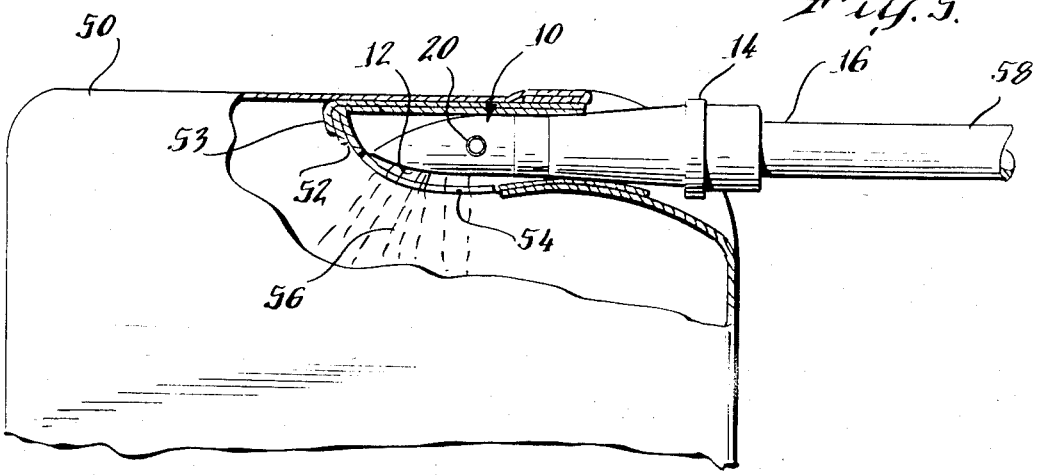
FIG. 5 is a cross-sectional view showing the nozzle filling a valve bag through a slitted valve sleeve.

The overall structure of a filling nozzle which can be used in conjunction with the filling system of the present invention is shown in FIGS. 1 and 2. The nozzle includes an elongated tube 10 which is hollow to provide a material passage 15 therethrough. In filling a valve bag, the nozzle is inserted into the bag as shown in FIG. 5. Product flows into end 16 of the nozzle through product supply conduit 58. The product, which is typically a particulate material, emerges from the nozzle through opening 12. The valve bag shown in FIG. 5 includes a valve sleeve 52 having a slit 54 therein through which particulate material 56 passes. Once particulate material 56 has passed through slit 54, it is within the interior of bag 50.

In valve bag filling nozzles of prior design, the opening at which the particulate product emerges for filling the bag is not designed to direct the flow of material exiting therefrom through a slitted valve sleeve. When such prior nozzles are used in conjunction with a slitted sleeve, such as sleeve 52 shown in FIG. 5, product is forced into the closed end 53 of sleeve 52 where it can become lodged or otherwise remain after the filling of the bag has been completed. Product remaining at end 53 of valve sleeve 52 can later find its way out of the valve sleeve, causing the material (which may be hazardous or toxic) to exit from the bag. Any such leakage of product from the bag is highly undesirable. Further, nozzles of prior design can cause the closed end 53 of valve sleeve 52 to rupture due to the direct force of material which impacts the closed end.

In the filling nozzle shown, opening 12 is situated so that when the nozzle is inserted into a slitted valve sleeve, the product flowing through the nozzle will be directed through the slit and into the bag, thereby minimizing the risk that the product will be caught in the closed end of the valve sleeve. The design of opening 12, by directing product downwardly, also prevents the rupture of the closed end of the valve sleeve.

The filling nozzle also includes various means for clearing the nozzle of residual particulate material after the product flow has ceased, and for removing any particulate material which may otherwise remain in the valve sleeve after the bag has been filled. Also provided is means for sealing the nozzle within the valve sleeve of a bag during the filling operation.

Figure 3:
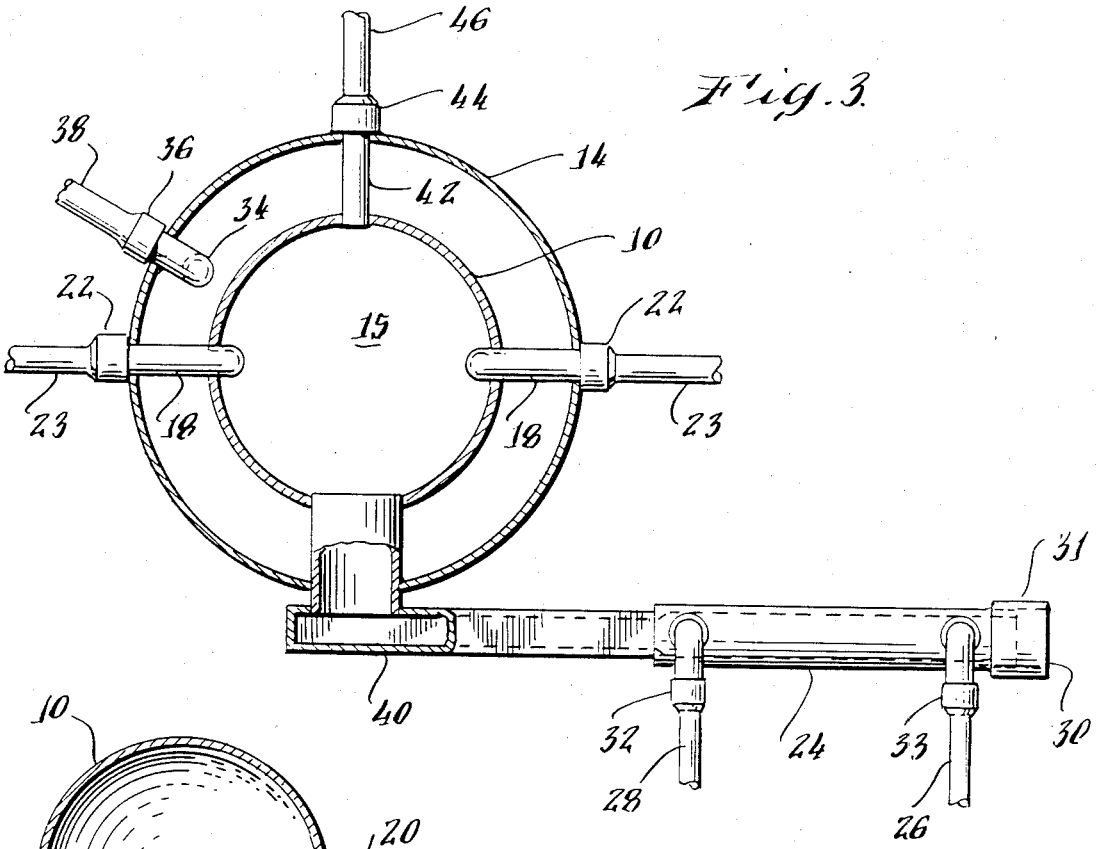
FIG. 3 is a cross-sectional view taken substantially along the line 3—3 shown in FIG. 2.

The sealing of the nozzle within a valve sleeve is accomplished by an inflatable rubber boot 14. Rubber boot 14 is inflated by a pressurized fluid, for example, pressurized air, which is introduced to the boot through a conduit 34. Conduit 34 is most clearly shown in FIGS. 2 and 3, and is connected to a hose 38 by coupling 36. Hose 38 is fed by a timed source of pressurized air which is caused by suitable control means (discussed hereinbelow) to inflate rubber boot 14 just after the nozzle is inserted into an empty valve bag, and to deflate rubber boot 14 just prior to the removal of the filled bag from the nozzle. The pressure used to inflate boot 14 will typically be on the order of 3 to 5 pounds per square inch.

After a bag has been filled with product flowing through the nozzle, and prior to the removal of the filled bag from the nozzle, a blast of high pressure air is introduced into material passage 15 of the nozzle to clear the nozzle of any particulate material remaining therein. The blast of high pressure air is passed through hose 46 to conduit 42. Hose 46 is coupled to conduit 42 by coupling 44. In the operation of the filling spout, the blast of high pressure air will typically be at a pressure on the order of 100 pounds per square inch.

After the high pressure blast clears material passage 15 of any remaining product, low pressure air at a pressure on the order of 50 pounds per square inch is introduced between the nozzle and the valve sleeve at ports 20. The low pressure air is carried to ports 20 by conduits 18. Conduits 18 are coupled, through couplings 22, to hoses 23 which carry the low pressure air. The term "low pressure" is used in describing this air source simply to differentiate it from the high pressure burst of air which is introduced into material passage 15 by conduit 42 and is used to clear material passage 15 of extraneous particulate material after a bag has been filled.

The purpose of providing a burst of low pressure air between the nozzle and the valve sleeve into which the nozzle is inserted is to suspend any particulate product material remaining in the bag sleeve after the bag has been filled. Any such particles remaining in the valve sleeve after the bag has been filled are referred to as "dribblings". After the dribblings have been suspended, a vacuum is drawn through conduit 40. Conduit 40 communicates with material passage 15. The vacuum is drawn as the nozzle is being removed from the bag, and as a result any suspended dribblings are sucked into material passage 15, and through conduit 40 to effect their removal from the bag. When the nozzle is used in conjunction with a slitted valve sleeve, as shown in FIG. 5, the internal pressure of the aerated product in the filled bag forces the slit to close, thereby preventing the vacuum within material passage 15 from sucking any product (other than dribblings) out of the filled bag. Thus, slit 54 can be analogized to a one way valve, which allows product to enter, but not exit from the bag.

Figures 6, 7, 8:
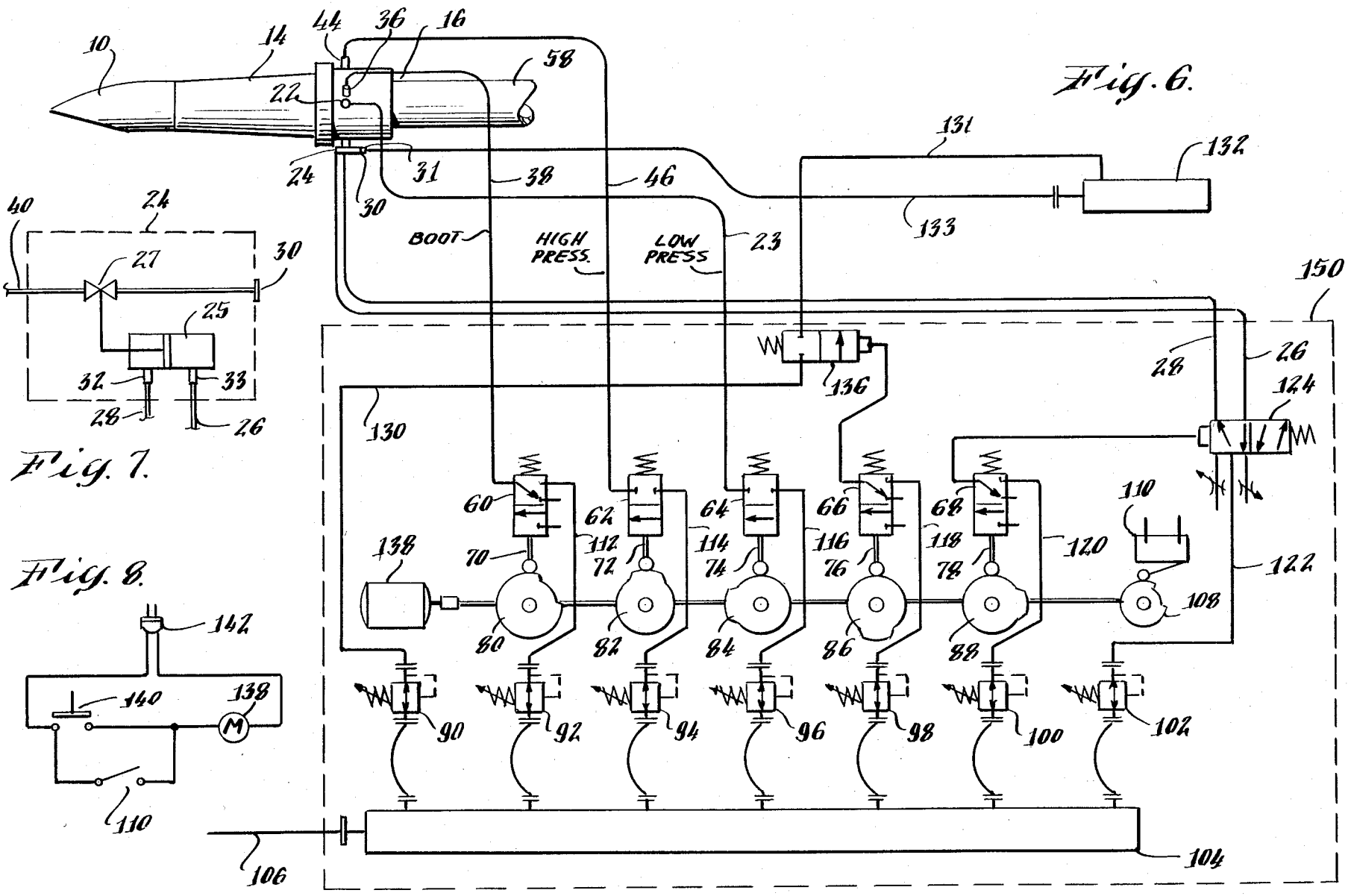
FIG. 6 is a schematic diagram of a control system apparatus in accordance with the present invention.
FIG. 7 is a schematic diagram of a vacuum valve arrangement, which can be used in conjunction with the present invention.
FIG. 8 is a schematic diagram of a power switching arrangement which can be used in conjunction with the present invention.

In order to effect proper timing of the vacuum which is drawn through conduit 40, a vacuum valve 24 is provided. As shown in FIG. 7, vacuum valve 24 includes a pneumatic actuator 25 controlled through ports 32 and 33 which are connected to a pressurized air source through hoses 28 and 26 respectively. Pneumatic actuator 25 controls the opening and closing of full port opening valve 27. In this manner, a vacuum source can be connected at end 30 of conduit 40 through a coupling 31. The vacuum source can be turned on prior to the time at which it is desired to draw a vacuum through conduit 40, to enable the vacuum to reach its full operating capacity. Then, when it is desired to draw the vacuum through conduit 40, pressurized air is introduced into port 32 of pneumatic actuator 25 to cause valve 27 to open. When it is desired to terminate the vacuum in conduit 40, pressurized air is introduced through port 33 to shut valve 27 off. The vacuum source attached at end 30 of conduit 40 can comprise a venturi or any other well known vacuum source.

Figure 4:
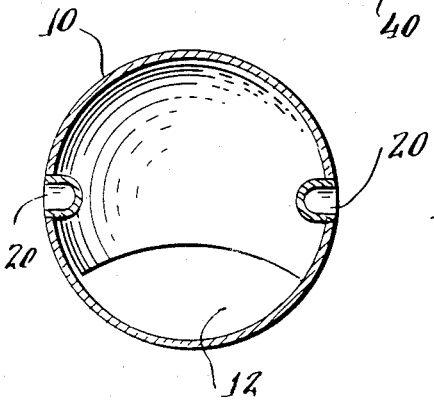
FIG. 4 is a cross-sectional view taken substantially the line 4—4 shown in FIG. 2.

The cross-section shown in FIG. 4 clearly shows the nozzle opening 12 and ports 20 which supply the low pressure air externally of tube 10.

FIG. 6 is a schematic diagram of the control system 150 of the present invention. The control system shown in FIG. 6 is connected to a nozzle of the type shown in FIGS. 1 through 5.

A motor 138 controls a series of cams 80, 82, 84, 86, and 88 to effect proper timing and control of the various air pressures used in the operation of the filling nozzle. A supply air manifold 104, which is coupled to a source of pressurized air through conduit 106, is used to provide a central source of high pressure air for operation of the control system. In an exemplary embodiment, the source of air connected to conduit 106 is at a pressure of 90–100 pounds per square inch ("p.s.i."). When the control system is used with a filling nozzle which includes an optional boot 14, the inflation of the boot is accomplished by a three-way cam operated normally closed valve 60. Valve 60 is coupled to supply air manifold 104 through an air pressure regulator 92. Valve 60 is actuated by cam follower 70 which rides on cam 80. Cam 80, rotated by motor 138, is arranged to actuate valve 60 after filling nozzle 10 is placed into the valve sleeve of a bag to be filled. Valve 60, through the operation of cam follower 70 and cam 80 will cause boot 14 to remain inflated until after the bag is filled, when it is desired to remove the filled bag from the filling nozzle. Conduit 112 connects pressure regulator 92 to valve 60. The output of valve 60 is connected to conduit 34 in the filling nozzle by hose 38.

The high pressure burst of air used to clear the filling nozzle of any residual product therein after a valve bag has been filled is provided by the operation of cam 82, cam follower 72, and two-way cam operated normally closed valve 62. Valve 62 is coupled to supply air manifold 104 through conduit 114 and air pressure regulator 94. After the bag has been filled, cam follower 72 is actuated by cam 82 to introduce a high pressure blast of air from supply air manifold 104, through hose 46, to conduit 42 through coupling 44 in the filling nozzle. When the rotation of cam 82 has caused the high pressure blast of air through the filling nozzle to end, cam 84 will be at a point at which it will actuate cam follower 74.

When cam follower 74 is actuated, two-way cam operated normally closed valve 64 provides low pressure air through hose 23 to coupling 22, and thereby conduit 18 in the filling nozzle. The low pressure air source is provided by an air pressure regulator 96 which is coupled to supply air manifold 104. Regulator 96 is coupled to valve 64 by conduit 116. After the low pressure air supplied by valve 64 suspends any product particles present in the valve of a valve bag, a vacuum is introduced into the material passage 15 of the filling nozzle to suck any suspended particles out of the valve.

In the control system embodiment shown in FIG. 6, the vacuum is produced by a venturi 132. Venturi 132 is coupled to supply air manifold 104 through a normally closed two way valve 136 and an air pressure regulator 90. Air from supply air manifold 104, which is regulated by air pressure regulator 90, passes through valve 136 to venturi 132 only when valve 136 has been actuated by three-way cam operated normally closed valve 66. Valve 66 is actuated by cam follower 76 which rides on cam 86. When actuated by cam 86 and cam follower 76, valve 66 is coupled through conduit 118 to pressure regulator 98 which, in turn, is coupled to supply air manifold 104. The output of valve 66 is coupled to actuate valve 136, and thereby provide air to operate venturi 132. When air flows to venturi 132, via conduits 130 and 131, a vacuum is produced. This vacuum is drawn through hose 133 which is coupled to material passage 15 of the filling nozzle through conduit 40, and valve 24. The open end of valve 24 is coupled at the open end 30 thereof to hose 133 through fitting 31.

After venturi 132 begins to draw a vacuum, vacuum valve 24 in the nozzle is caused to open so that the vacuum can be drawn through material passage 15. The opening of vacuum valve 24 is effected by cam 88 which actuates cam follower 78 on three-way cam operated normally closed valve 68. Valve 68 receives its air supply through conduit 120 which is coupled to air pressure regulator valve 100, supplied by supply air manifold 104. When actuated, valve 68 supplies air pressure to an air piloted 4-way valve 124. Valve 124 supplies air from supply air manifold 104, air pressure regulator 102, and conduit 122 to pneumatic actuator 25. Pneumatic actuator 25 is a part of vacuum valve 24 as shown in FIG. 7. Pneumatic actuator 25 is controlled through ports 32 and 33 thereof which are connected to pressurized air from valve 124 by hoses 28 and 26 respectively. Upon receiving pressurized air from valve 124, pneumatic actuator 25 causes full port opening valve 27 to open, thereby drawing the vacuum produced by venturi 132 through material passage 15.

Cam 108 is provided to actuate a microswitch 110, which supplies power to motor 138 of control system 150 as shown in FIG. 8. Power from receptacle 142 is connected in series to motor 138 through a momentary contact switch 140. Microswitch 110, actuated by cam 108, is placed in parallel with switch 140. In operation, after a bag to be filled has been placed on nozzle 10, an operator turns on switch 140 to provide initial power to motor 138. When motor 138 rotates, cam 108 rotates to close microswitch 110, thereby maintaining motor 138 in its powered condition throughout the bag filling cycle. At the end of the bag filling cycle, cam 108 turns microswitch 110, and thereby motor 138, off. At this point, the bag filling apparatus is ready to commence a new cycle, after a new bag has been placed on the filling nozzle.

We claim:

1. A system for controlling the filling of a valve bag with particulate material, said bag including a generally tubular filling valve, said system being used with a source of pressurized air and a filling nozzle dimensioned to fit in the filling valve, said system comprising:

first, second and third cams;

means for driving said cams;

a supply air manifold;

means for coupling said supply air manifold to the source of pressurized air;

a first cam actuated valve means coupled to said supply air manifold and adapted to be sequentially opened and closed by said first cam for providing a high pressure blast of air into the filling nozzle after a valve bag has been filled to clear remaining particulate material from said nozzle;

a second cam actuated valve means coupled to said supply air manifold and adapted to be sequentially opened and closed by said second cam after said first cam actuated valve means has been closed for providing a low pressure blast of air into the filling valve externally of the filling nozzle, to suspend particulate material accumulated in the filling valve; and a third cam actuated valve means coupled to said supply air manifold and adapted to be sequentially opened and closed by said third cam after said second cam actuated valve means has been closed for providing a vacuum for introduction into the filling nozzle to remove the suspended particulate material from said filling valve as the nozzle is removed therefrom.

2. The control system of claim 1 further including a venturi coupled to said supply air manifold and said third cam actuated valve means wherein said third cam actuated valve means controls the input of pressurized air from said supply air manifold to the venturi.

3. The control system of claim 2 further comprising:

a vacuum valve connected in series between said venturi and said filling nozzle; and a fourth cam actuated valve means coupled to said supply air manifold and adapted to be actuated by another of said cams for causing said vacuum valve to open after the actuation of said third cam actuated valve.

4. The control system of claim 3 further comprising a fifth cam actuated valve means coupled to said supply air manifold and adapted to be actuated by another of said cams prior to the filling of a valve bag for providing pressurized air to inflate a boot surrounding a portion of the filling nozzle.

5. The control system of claim 4 further comprising first, second, third, fourth, and fifth air pressure regulators coupled between said supply air manifold and said first, second, third, fourth, and fifth cam actuated valve means respectively.

6. The control system of claim 1 further comprising another cam actuated valve means coupled to said supply air manifold and adapted to be actuated by another of said cams prior to the filling of a valve bag for providing pressurized air to inflate a boot surrounding a portion of the filling nozzle.

* * * * *